US006053587A

United States Patent [19]

Boerder

[11] Patent Number: 6,053,587

[45] Date of Patent: Apr. 25, 2000

[54] PORTABLE WORKSHOP

[75] Inventor: Eugene F. Boerder, Dallas, Tex.

[73] Assignee: E. F. Boerder Co., Dallas, Tex.

[21] Appl. No.: 09/306,708

[22] Filed: May 7, 1999

[51] Int. Cl.[7] ..... A47B 46/00

[52] U.S. Cl. ..... 312/249.12; 312/282; 312/314; 280/47.35; 280/47.18; 280/30

[58] Field of Search ..... 312/249.8, 249.9, 312/249.11, 249.12, 249.13, 281, 282, 313, 314, 315, 316, 317.3; 280/47.35, 47.26, 47.18, 30; 108/134

[56] References Cited

U.S. PATENT DOCUMENTS

| | | | |
|---|---|---|---|
| 3,148,923 | 9/1964 | Smith | 312/282 X |
| 3,667,484 | 6/1972 | Reis | 312/282 X |
| 3,715,148 | 2/1973 | Beals | 312/249.11 X |
| 3,873,114 | 3/1975 | Brown | 280/30 |
| 3,880,485 | 4/1975 | Schmelzer | 312/282 |
| 4,856,435 | 8/1989 | Larson | 108/134 |
| 5,423,651 | 6/1995 | Dinverno | 312/249.11 X |
| 5,518,258 | 5/1996 | Cox | 108/134 X |
| 5,848,798 | 12/1998 | Halvorson, Jr. et al. | 280/47.35 |
| 5,860,658 | 1/1999 | Callahan | 280/30 |
| 5,927,837 | 7/1999 | Schmidt | 312/249.11 |
| 5,967,632 | 10/1999 | Lamia | 312/249.8 X |

*Primary Examiner*—Peter M. Cuomo
*Assistant Examiner*—Hanh V. Tran
*Attorney, Agent, or Firm*—Michael A. O'Neil

[57] ABSTRACT

A portable workshop includes a storage cabinet having shelves in lower portions thereof for receiving relatively large, heavy items and drawers in the upper portion thereof for receiving relatively small tools, accessories, and supplies. The storage cabinet is supported on wheels and casters for movement. The storage cabinet includes a top comprising the work surface. A work table top is supported on the storage cabinet for pivotal movement between a storage orientation and a working orientation. A retractable handle is utilized for manipulating the portable workshop on the wheels and casters.

2 Claims, 3 Drawing Sheets

10
30
36
42
20
20
34
50
40
46
32
12
18
48
16
14
24
52
26
22
26
28

PORTABLE WORKSHOP

TECHNICAL FIELD

This invention relates generally to portable workshops, and more particularly to a fully portable and transportable workshop and storage cabinet for receiving, storing, and transporting tools, accessories, and supplies, and providing a work surface to facilitate utilization thereof.

BACKGROUND AND SUMMARY OF THE INVENTION

The vast majority of American households are equipped with a variety of tools such as screwdrivers, pliers, hammers, saws, electric drills, etc., which are used for repairs, building projects, hobbies, and crafts. Particularly in the case of apartments, condominiums, and smaller houses, the storage and transportation of tools and the attendant accessories and supplies has been a considerable problem. Typically, the tools, etc., are stored in a drawer which is inconveniently located, thereby necessitating multiple trips to carry the tools, accessories, and supplies to and from the location at which they are needed.

The present invention comprises a portable workshop which overcomes the foregoing and other problems long since associated with the prior art. In accordance with the broader aspects of the invention, a portable workshop includes a storage cabinet which is small enough in size to be stored in a closet, but large enough to receive, store, and transport all of the tools, accessories, and supplies which are normally used in and around the home. The cabinet is supported on wheels and casters and is therefore easily transportable from its storage area to a location at which the tools, etc., are needed. The portable workshop further includes a work surface comprising a table top supported on the storage cabinet for pivotal movement between a storage orientation and an extended working orientation.

In accordance with more specific aspects of the invention, the storage cabinet includes a plurality of shelves adapted to receive larger, heavier tools. The shelves are located in the lower portion of the storage cabinet to facilitate stability. A plurality of relatively small drawers are located in the upper portion of the storage cabinet to receive small tools, accessories, supplies, etc. The length dimension of the lower portion of the storage cabinet is preferably larger than the length dimension of the upper portion thereof, again to facilitate stability.

The portable workshop is provided with a handle which is pivotally mounted to facilitate movement of the portable workshop on the wheels and casters. The portable workshop is provided with a retractable power cord which is utilized to supply electrical power to duplex outlets, thereby facilitating the use of electrical tools. The table top is secured in the extended working orientation by a pair of removable metal legs which are adapted for stowage on the portable workshop.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
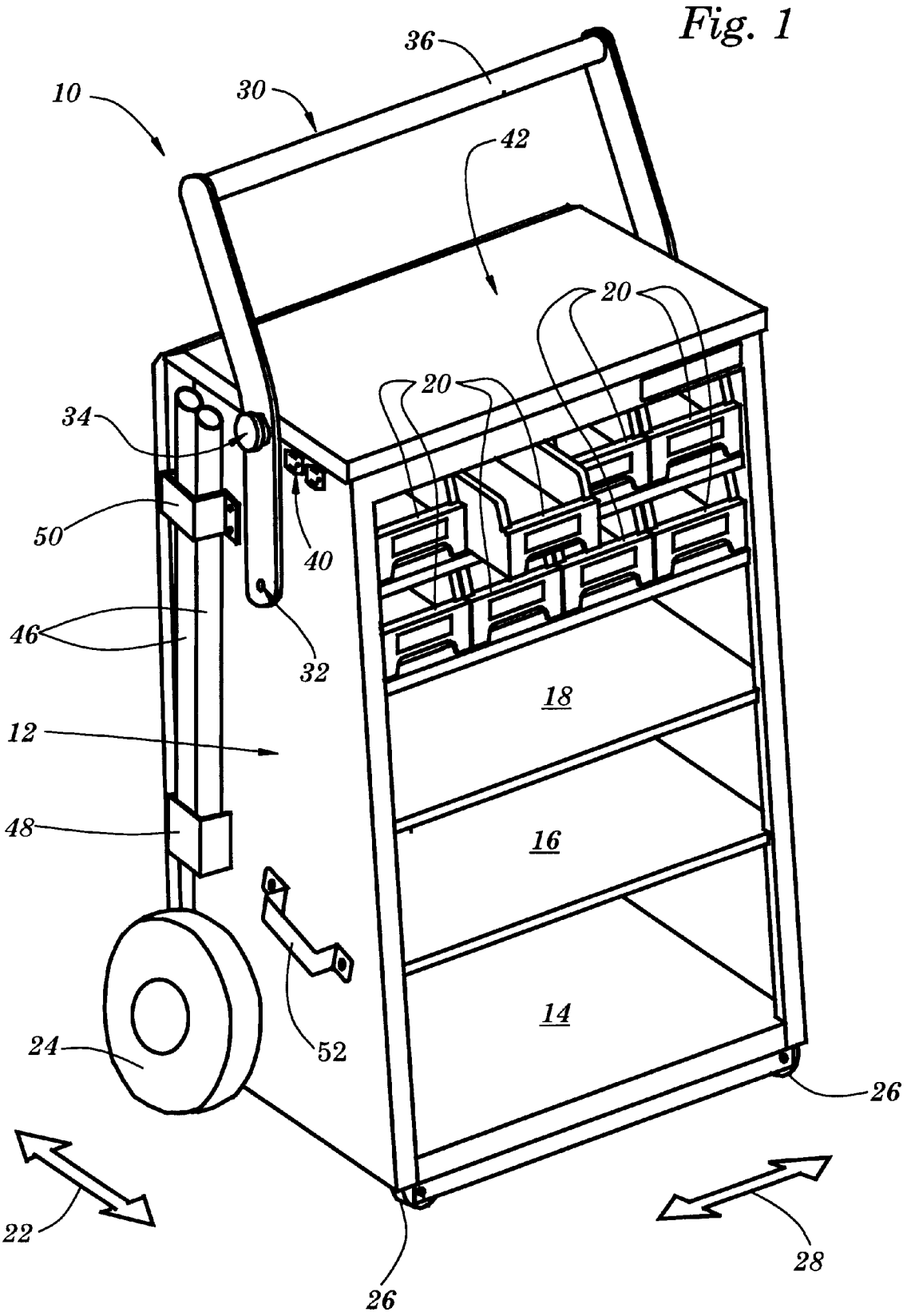
FIG. 1 is a front left prospective view of the portable workshop of the present invention showing the table top thereof in its storage orientation.

Referring now to the Drawings, and particularly to FIG. 1 thereof, there is shown a portable workshop 10 incorporating the preferred embodiment of the present invention. The portable workshop 10 includes a storage cabinet 12 which is preferably formed from metal or plastic and which includes three shelves 14, 16, and 18 situated in the lower portion thereof and a plurality of drawers 20 which are slidably supported in the upper portion thereof. The drawers 20 may be formed from various plastic materials utilizing well known injection molding techniques; however, other materials may be utilized in the fabrication of the drawers 20 if desired.

In the utilization of the storage cabinet 12, the shelves 14, 16, and 18 are utilized to receive, store, and transport relatively heavy items such as electric drills, various types of sanders, various types of saws, grinders, hammers, routers, clamps, portable vices, glue guns, etc. The location of the shelves 14, 16, and 18 in the lower portion of the storage cabinet 12 to receive relatively heavy items is highly advantageous in that it lends stability to the portable workshop 10. The drawers 20 are used to receive, store, and transport small tools, accessories, and supplies. The positioning of the drawers 20 in the upper portion of the storage cabinet 12 is highly advantageous in that the small tools, accessories, and supplies stored therein are readily accessible and easy to find.

The lower portion of the storage cabinet 12 is relatively larger in the length direction as indicated by the arrow 22 as compared with the upper portion thereof. This is advantageous for at least two reasons. First, the larger dimension of the lower portion of the storage cabinet 12 adds stability to the portable workshop 10. Second, the larger dimension of the lower portion of the workshop is advantageous in facilitating the storage and transportation of relatively large, heavy items. It will be understood, however, that the top and bottom of the cabinet may have identical dimensions depending upon the requirements of particular applications of the invention.

The storage cabinet 12 and therefore the entire portable workshop 10 is supported on a pair of rubber wheels 24 located at the rear of the storage cabinet 12 and a pair of casters 26 located at the front of the storage cabinet 12. The wheels 24 are supported for rotation about an axis extending parallel to the width dimension of the storage cabinet 12 as indicated by the arrow 28. The casters 26 are supported for rotation about axes extending parallel to the length dimension as indicated by the arrow 22. In this manner the portable workshop 10 is readily positional in both the length direction and the width direction.

Figure 2:
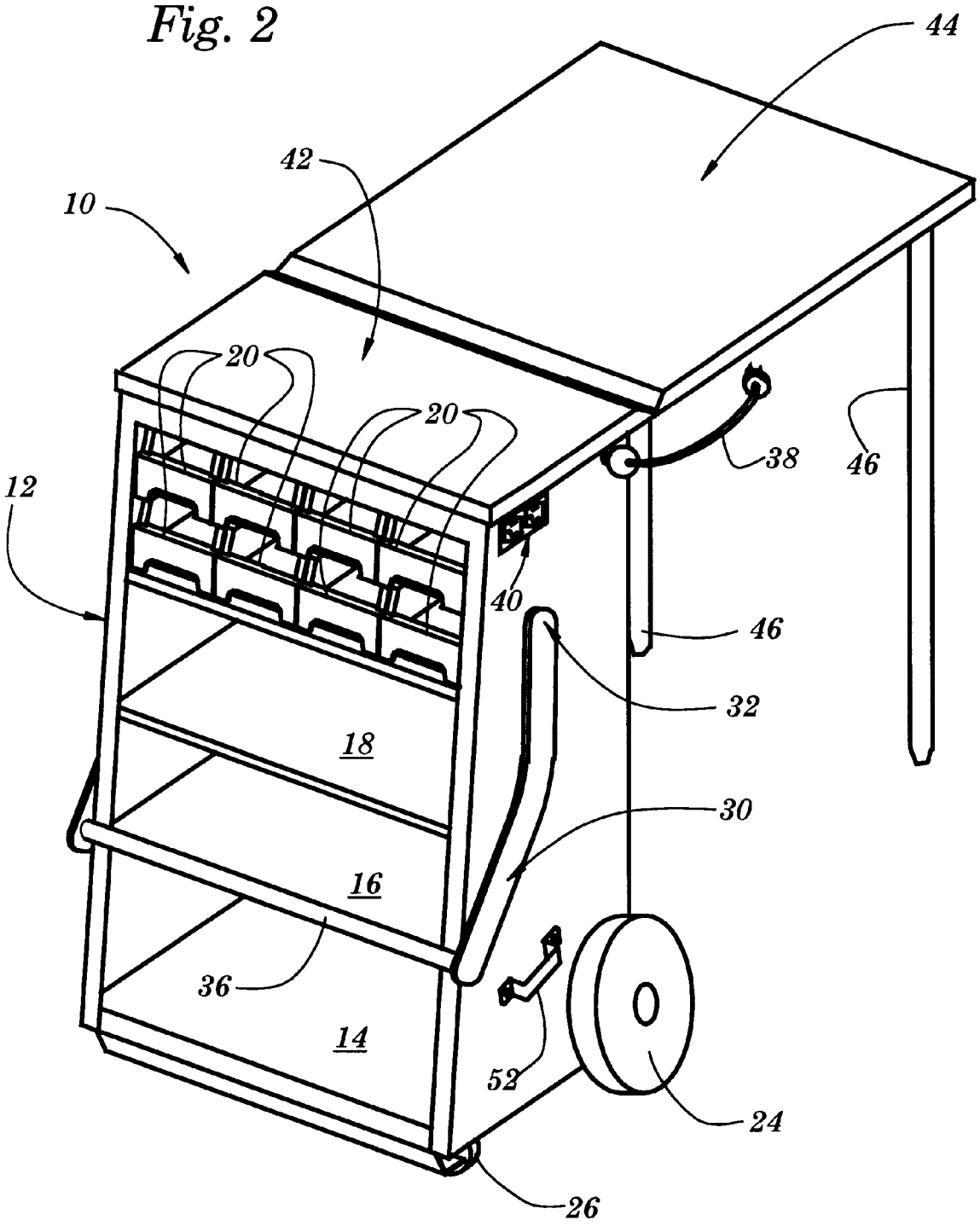
FIG. 2 is a right front prospective view of the portable workshop of FIG. 1 showing the table top thereof in its extended working orientation.

The portable workshop 10 is provided with a folding handle 30. The handle 30 is shown in FIG. 1 in its extended position wherein the handle 30 facilitates positioning of the portable workshop 10 on the wheels 24 and the casters 26. The handle 30 is pivotally supported on pivot members 32 and is adapted for retention in the extended position by retainers 34. As illustrated in FIG. 2, upon release of the retainers 34, the handle 30 may be pivoted into a retracted orientation wherein a handlebar 36 thereof extending across the width of the storage cabinet 12 is aligned with the shelf 16 so that it does not impede access thereto.

The storage cabinet 12 is preferably provided with a retractable electrical cord 38 which may be extended for connection to a suitable convenience outlet. The retractable electrical cord 38 is utilized to supply electric power to a pair of duplex outlets located on opposite sides of the storage cabinet 12 at the upper end thereof. In this manner the use of electrical tools in conjunction with the portable workshop 10 is facilitated.

The storage cabinet 12 is provided with a top 42 which is of adequate size to serve as a work surface for small projects. A table top 44 is supported on the storage cabinet 12 for pivotal movement between the retracted orientation shown in FIG. 1 and the working orientation shown in FIG. 2. The table top 44 is secured in the working orientation by a pair of removable metal legs 46. When not in use, the legs 46 are stowed on one side of the storage cabinet 12 in a retainer 48 and a sleeve 50.

A pair of handles 58 are provided on opposite sides of the storage cabinet 12. The handles 58 are useful in manipulating the portable workshop 10 into and out of a car trunk, pickup bed, etc. The handles 58 may be utilized to receive, store and transport a level or similar tools which are too long to be stored in the shelves 14, 16, and 18.

Figure 3:
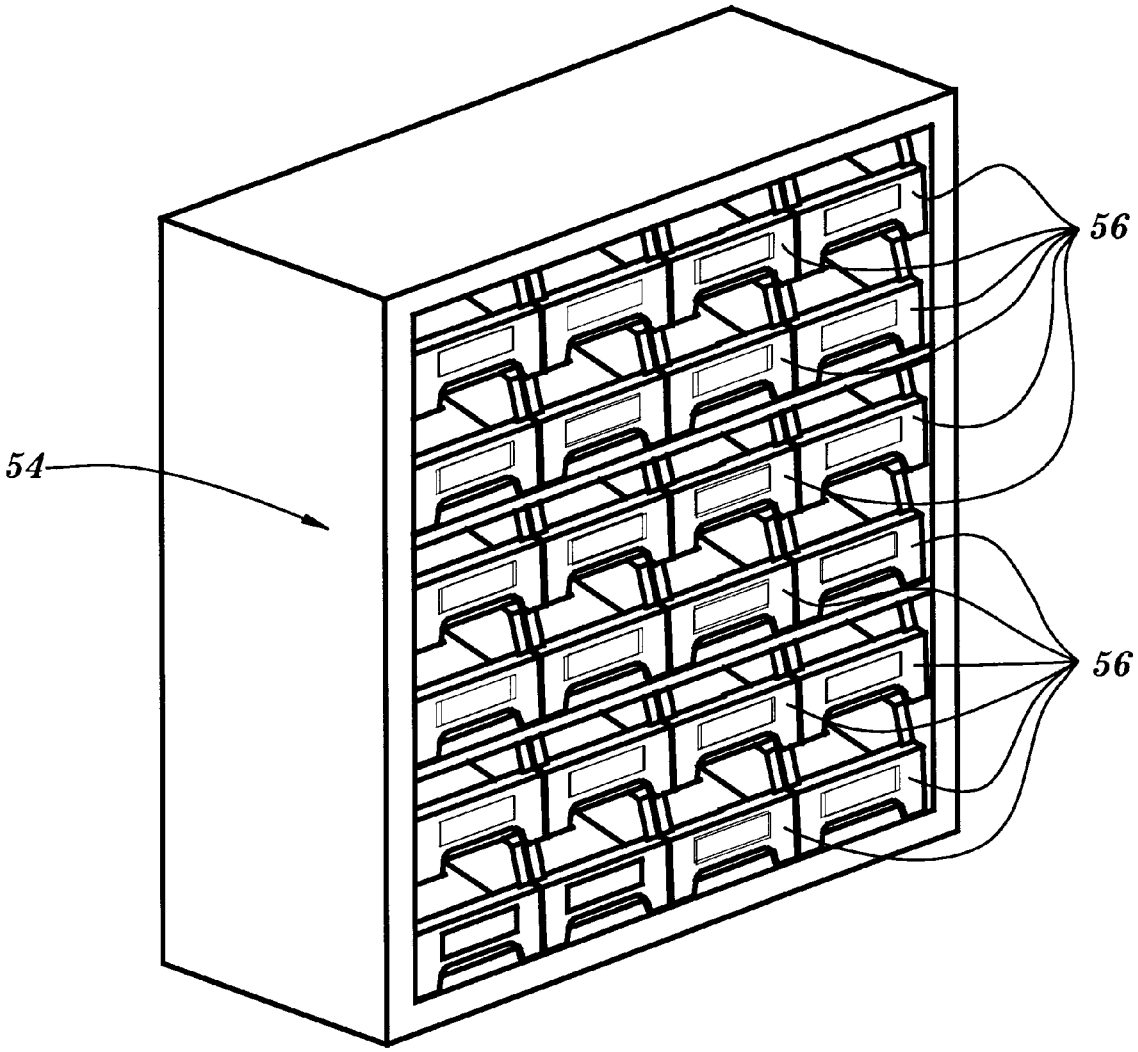
FIG. 3 is a front left prospective view of an accessory cabinet useful in conjunction with the portable workshop of FIGS. 1 and 2.

Referring to FIG. 3, there is shown an accessory cabinet 54 useful in conjunction with the portable workshop 10 in the present invention. The accessory cabinet 54 is preferably constructed from metal and comprises a plurality of drawers 56 which are identical in construction and dimension to the drawers 20 of the storage cabinet 12. The accessory cabinet 54 is preferably supported on a wall at the location in which the portable workshop 10 is stored. The drawers 56 may be subdivided into groups of drawers associated with particular projects such as painting, electrical repair, auto repair, boat repair, etc. Then, whenever such a task is to be undertaken, one or more of the drawers 20 of the portable workshop 10 can be exchanged for a like number of drawers 56 of the accessory cabinet 54. The portable workshop 10, now equipped with all of the tools, accessories and supplies required for a particular project, is then removed to the work location.

Although particular embodiments of the invention having been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A portable workshop comprising:

a storage cabinet having a predetermined length dimension and a predetermined width dimension;

a plurality of relatively large shelves located in the lower portion of the storage cabinet to receive relatively large, heavy items;

a plurality of removable drawers slidably mounted in the upper portion of the storage cabinet to receive relatively small tools, accessories, and supplies;

a pair of rubber wheels mounted on the storage cabinet for rotation about an axis extending parallel to the width dimension and supporting the portable workshop for transportation;

a pair of casters mounted for rotation about axes extending parallel to the length dimension and supporting the portable workshop for movement;

a handle including a pair of pivotally supported arms and a handlebar extending between the arms;

the handle being pivotally supported between an extended position wherein the handlebar extends over a top of the storage cabinet and a retracted position wherein the handlebar extends across a front of the storage cabinets and is a aligned on a horizontal plane with one of the shelves of the storage cabinet;

the storage cabinet top comprising a work surface;

a table top supported on the storage cabinet for pivotal movement between a retracted orientation wherein the table top extends generally vertically and a working orientation wherein the table top extends generally horizontally and in alignment with the top of the storage cabinet;

a pair of removable legs for securing the table top in the working orientation;

an apparatus mounted on the storage cabinet for stowing the removable legs not in use;

a pair of handles mounted on opposite sides of the storage cabinet for use in manipulating the portable workshop into and out of vehicles;

a retractable power cord mounted on the storage cabinet for connection to an electrical convenience outlet to supply electrical power to the portable workshop; and at least one duplex outlet mounted on the storage cabinet and electrically connected to the retractable power cord for supplying electrical power to electrical tools utilized in conjunction with the portable workshop.

2. The portable workshop of claim 1 wherein the length dimension of the storage cabinet at the lower end being relatively longer than the length dimension at the upper end of the storage cabinet to stabilize the portable workshop.

* * * * *